US007182418B2

(12) United States Patent
Harvey et al.

(10) Patent No.: US 7,182,418 B2
(45) Date of Patent: Feb. 27, 2007

(54) DROPLET DEPOSITION APPARATUS

(75) Inventors: Robert Harvey, Cambridge (GB); Stephen Temple, Cambridge (GB); Howard J. Manning, Edinburgh (GB); Peter Stanier, Cambridgeshire (GB); Christopher D. Philips, Bedforshire (GB)

(73) Assignee: XAAR Technology Limited, Cambridge (GB)

( * ) Notice: Subject to any disclaimer, the term of this patent is extended or adjusted under 35 U.S.C. 154(b) by 168 days.

(21) Appl. No.: 10/487,777

(22) PCT Filed: Sep. 5, 2002

(86) PCT No.: PCT/GB02/04062

§ 371 (c)(1),
(2), (4) Date: Aug. 5, 2004

(87) PCT Pub. No.: WO03/022586

PCT Pub. Date: Mar. 20, 2003

(65) Prior Publication Data

US 2005/0007399 A1 Jan. 13, 2005

(30) Foreign Application Priority Data

Sep. 11, 2001 (GB) ..... 0121909.6

(51) Int. Cl.
*B41J 29/38* (2006.01)

(52) U.S. Cl. ..... 347/6; 347/17

(58) Field of Classification Search ..... 347/6
See application file for complete search history.

(56) References Cited

U.S. PATENT DOCUMENTS 4,462,037 A * 7/1984 Bangs et al. ..... 347/85
4,494,124 A * 1/1985 Piatt et al. ..... 347/89

FOREIGN PATENT DOCUMENTS

| | | | |
|---|---|---|---|
| EP | 277 703 A1 | | 8/1988 |
| EP | 278 590 A1 | | 8/1988 |
| EP | 390 198 A2 | | 10/1990 |
| EP | 390 198 A3 | | 10/1990 |
| EP | 908 316 A1 | | 4/1999 |
| EP | 0 839 656 B1 | | 6/2000 |
| WO | WO 00/24584 | | 5/2000 |
| WO | WO 00/29217 | | 5/2000 |
| WO | WO 00/38928 | * | 7/2000 |
| WO | WO 00/68018 | | 11/2000 |

OTHER PUBLICATIONS

International Search Report in PCT/GB02/04062 dated Mar. 25, 2003.

* cited by examiner

*Primary Examiner*—Vip Patel
*Assistant Examiner*—Jannelle M. Lebron
(74) *Attorney, Agent, or Firm*—Marshall, Gerstein & Borun LLP

(57) ABSTRACT

An ink supply system for a droplet deposition apparatus wherein the pressure at the nozzle is controlled by a remote point, said remote point being positioned in parallel with said print head. The flow restrictions in the printhead arm and the pressure control arm of the circuit being selected to achieve this.

18 Claims, 7 Drawing Sheets

DROPLET DEPOSITION APPARATUS

This is the U.S. national phase of International Application No. PCT/GB02/04062 filed Sep. 5, 2002, the entire disclosure of which is incorporated herein by reference.

The present invention relates to printers and in particular droplet deposition ink jet printers Ink jet printers are no longer viewed simply as office printers, their versatility means that they are now used in digital presses and other industrial markets. It is not uncommon for print heads to contain in excess of 500 nozzles and it is anticipated that "page wide" print heads containing over 2000 nozzles will be commercially available in the near future.

These print heads are typically "end shooters" i.e. the channel or ejection chamber has an ink inlet and a nozzle through which the ink is ejected. Ink flows into the chamber via the ink inlet and the only way for the ink to leave the chamber is via the nozzle.

It has been found that certain benefits are achieved where an ink outlet is added to the ejection channel in addition to the ink inlet and the ejection nozzle. Ink is caused to flow through the channel—even while printing—which helps to reduce the probability of particles or bubbles blocking the nozzle.

Because of the size of these industrial printers, a large amount of ink is ejected from the heads when printing full black i.e. all the ejection chambers are printing at their maximum rate. It is proposed in print heads of the prior art that a flow rate through the print head of around ten times the maximum printing rate is used in order to help flush dirt out of the print head and maintain the head at a constant temperature.

It is preferred that the nozzles are kept at just below atmospheric pressure since a pressure above atmospheric may result in weeping of ejection fluid and pressures significantly below atmospheric may cause the sucking of air into the ejection chamber. Neither of these effects provide stable operation and are therefore undesirable.

Because of the ink circulation, there is provided an inlet manifold and an outlet manifold. There is a significant pressure drop in the print head between the inlet and outlet manifolds and to ensure the correct pressure at the nozzle the pressures in both the inlet and outlet manifolds may be specified. The inlet manifold pressure being positive and the outlet manifold pressure being negative and of a slightly greater magnitude than the inlet pressure.

These pressures can be achieved using a gravity feed system utilising an upper and lower reservoirs, ink supplied to the print head from the upper reservoir and a pump being provided to return the un-ejected ink that collects in the lower reservoir back to the upper reservoir. In order to provide the necessary pressures.

Whilst this arrangement is acceptable for static applications and where a large machine is not an issue, there is a need for an ink supply system that is more compact. It is an object of the present invention to address this and other problems.

Accordingly, the present inventions consists in one aspect in droplet deposition apparatus comprising: at least one print head each having at least one nozzle for ejecting fluid from that print head; fluid supply means for supplying fluid under pressure to said at least one print head; and pressure control means, located in said fluid supply means in parallel with the or each print head, for adjusting fluid pressure within said fluid supply means in order to control the fluid pressure at the or each nozzle.

Preferably, pressurizing means are located in said fluid supply means in parallel with the or each print head and said pressure control means.

Advantageously, a junction is provided in said fluid supply means downstream of said pressurizing means wherein, said junction divides said fluid supply means into at least two arms, and where downstream of said junction said pressure control means are located in one arm and the or each print heads are located in a different arm.

Suitably, a further junction is provided in said fluid supply means downstream of said pressure control means and wherein, said further junction combines fluid in the arm from said pressure control means and fluid in the arm from the or each print head into a combined conduit.

According to a preferred embodiment a junction is provided downstream of the pump, and fluid is directed along one arm to the print head and along the other arm to a pressure reference point, said arms combining at a further point to form a single conduit that feeds the pump. Reference point A is connected to means capable of adjusting the pressure at reference point A and consequently the pressure at the nozzle. In the preferred embodiment this is a small reservoir open to the atmosphere and which can be raised or lowered in order to affect the pressure at the nozzle. In alternative embodiments the means for adjusting the pressure is a pressurized container.

Careful selection of the resistances in the pressure reference arm with reference to the resistance in the printhead allows for control of the pressure at the nozzle by manipulating the pressure at a remote point arranged in parallel to the printhead.

Preferably, the flow resistance upstream of reference point A and upstream of the at least one nozzle are substantially identical and the flow resistance downstream of reference point C and downstream of the at least one nozzle are also substantially identical. The flow resistance of the upstream and downstream conduits either side of reference point A being substantially the same.

The flow resistance in the conduit either side of reference point A can be specified through the use of restrictors. The restrictors can be simple hardware, such as pipes having a particular flow resistance, or more complex hardware such as valves and the like. If pipes are used it is preferable that substantial lengths of a moderate inner diameter are used rather than short lengths of a narrow inner diameter, erosion and accretion of dirt will then be unlikely to spoil the symmetry of the system.

Ink preferably flows at a higher rate round the pressure control arm than round the print head arm of the circuit which means that a dirt particle within the circuit less of a chance to flow through the print head simply because more ink flows through the pressure control arm.

The symmetry of the system is not perfect however, as the pump and the filter cannot both be placed on the "plane of symmetry". However, pump degradation and filter loading, within reason, do not significantly affect matters. Even substantial pressure drop through the filter, or pump wear merely lowers the flowrate through the main restrictors and hence the pressure drop across them. This in turn reduces the flow rate through the print head, which is not critical.

Another element of asymmetry is the fact that ink is ejected from the print head, so while a particular flow enters the head, a smaller amount remains in the conduit down stream of the print head. Typically a flow of 10 times maximum printing rate enters the head and correspondingly a flow of between 9 and 10 times maximum printing rate leaves the head. An amount of ejection fluid between 0 and 1 times the maximum printing rate being ejected by the print head.

Ink to make up amount of ink that is ejected by the print head is preferably added to the supply circuit at the point at which the two supply arms combine downstream of the nozzles and the pressure reference point A.

In a further embodiment of the present invention, the print head is mounted onto a scanning carriage. The bulk supply reservoir and the pressure adjustment reservoir are mounted onto a static part of the printer, all the other equipment mounted onto the carriage. Accelerations at the ends of the carriage motion are controlled by buffering the resulting pressure fluctuations at A. Alternatively, the pressure adjustment reservoir can be mounted on the scanning carriage at a point below that of the nozzles in the print head. Beneficially this reduces the effects of the acceleration on the pressure within the supply circuit.

In another aspect, the present invention consists in a method of providing a flow of ink through an ink chamber having an ink inlet port at which a positive ink pressure is established, an ink ejection orifice and an ink outlet port at which a negative ink pressure is established, characterised by the flow of ink external to the chamber through a series connection of a first flow restrictor, a reference pressure device and a second flow restrictor to define respective positive and negative ink pressures at the ends of the first and second flow restrictors remote from the reference pressure device and the application of said positive and negative ink pressures to the inlet and outlet ports respectively of the ink chamber.

Advantageously, the reference pressure device operates through exposure of an ink surface to a defined air pressure which is preferably controllable and may be atmospheric pressure.

Suitably, the first and second flow restrictors are balanced with the restriction to ink flow in the chamber between the ink inlet port and the ink ejection orifice and between the ink ejection orifice and the ink outlet port so that the ink pressure at the ink ejection orifice is defined by the reference pressure device.

In yet another aspect, the present invention consists in a method of supplying ink to a print head where the pressure at the nozzle is controlled by a remote point, said remote point being positioned in parallel with said print head.

In still a further aspect, the present invention consists in a method of supplying ink to an ink chamber having a nozzle, wherein parallel flows are established in the ink chamber and in a pressure control path; the parallel flows being balanced such that the pressure at the nozzle is defined by the pressure applied at a reference point in the pressure control path.

Advantageously, the pressure control path comprises a series connection of a first flow restrictor, a reference pressure device defining said reference point and a second flow restrictor.

Preferably, the reference pressure device operates through exposure of an ink surface to a defined and preferably controllable air pressure, which may be atmospheric pressure.

Suitably, the flow of ink through said pressure control path is greater than the flow of ink through the ink chamber.

The present invention will now be described, by way of example only, with reference to the following drawings, in which.

Figure 1:
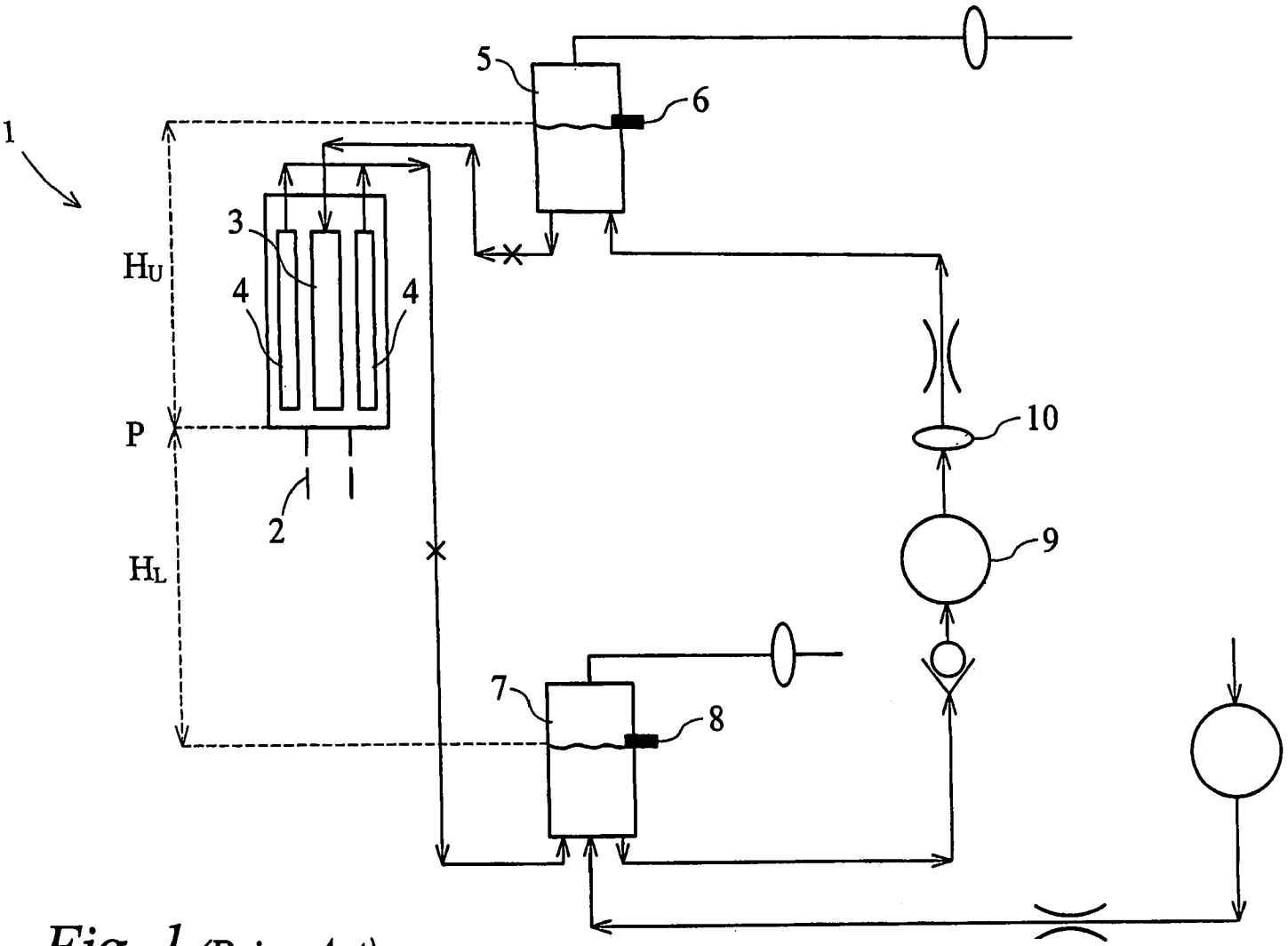
Fig. 1 (Prior Art)
FIG. 1 is a gravity feed ink supply circuit according to the prior art.

FIG. 1 depicts a gravity feed ink supply system according to the prior art. A print head 1 is capable of firing a liquid 2 from nozzles located on the underside of the head. The ink chambers that eject the nozzles are arranged in two parallel arrays and supplied with ink from a central manifold 3 and un-ejected ink is removed from the print head by two outlet manifolds 4.

Ink is continually supplied to the print head from an upper reservoir 5, the level of liquid within the reservoir being controlled by a level sensor 6. The rate of ink flow is of the order ten times the maximum drop ejection rate. Because of the small size of the ejection chambers and the high pressure drop across them, a high pressure is required going into the print head in order to realise a slightly negative pressure at the nozzles. This pressure is achieved through the provision of a pressure head $H_u$ which is the difference between the height of liquid in the reservoir and the nozzles. Typically the pressure at the inlet manifold must be of the order +2800 Pa.

The nozzles in the chambers are located mid way between the inlet manifold 3 and the outlet manifold 4. The pressure drop in the printer either side of the nozzle is therefore substantially identical. Ink that is flowing through the chamber passes to a lower reservoir, in which the level of liquid is controlled by a level sensor 8. The height difference $H_L$ between the nozzles and the surface of the fluid in the lower reservoir defines the pressure at the nozzles, which must be at a substantial negative pressure of approximately −3200 Pa. This achieves a pressure at the nozzle that is just below atmospheric.

Ink is returned to the upper reservoir via a filter 10 using a pump 9. In this arrangement, the print head and pressure reference points are arranged in series.

Typically $H_U$ is of the order 280 mm and $H_L$ of the order 320 mm. WO 00/38928 (incorporated herein) describes this ink supply in greater detail and consequently it will not be described in any more detail here.

Figure 2:
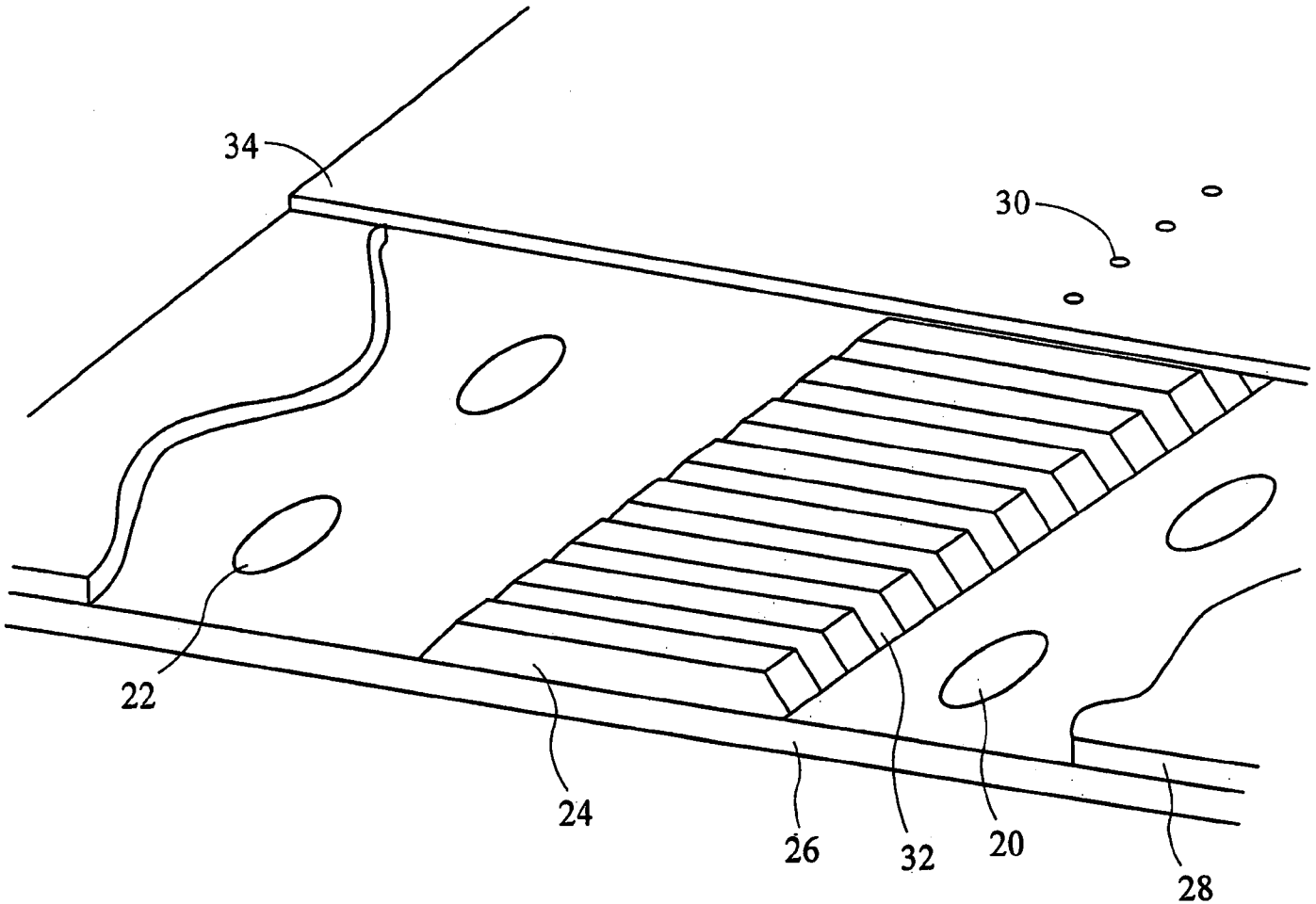
Fig. 2 (Prior Art)
FIG. 2 depicts a through flow ink jet print head.

FIG. 2 is a perspective view of a continuous flow drop on demand inkjet printhead. A block of piezoelectric material 24 has channels 32 formed by a sawing process. The piezoelectric block is polarised in its thickness direction and electrodes (not shown) are provided on either side of each wall bounding the channels. Upon activation of a field between the electrodes on opposing sides of the walls, the walls deflect in shear and hence pressurize the ink contained within the channels. This causes a drop to be ejected from the nozzles 30 formed in a cover plate 34. The mechanics of such drop ejection is well known and described in the prior art, see for example EP-A-0 277 703 or EP-A-0 278 590 and incorporated herein.

This structure and other structures, single and double row actuators are also well known in the prior art; see WO 00/24584 and WO 00/29217 amongst others (both of these applications incorporated herein).

In this single row actuator, ink is supplied to the actuator through ports 20 formed in a base 26 and removed from the actuator through ports 22 also located in the base, but at the opposite end of the channel. A support 28, with the cover 34 and the base 26 defines a manifold.

The present invention will now be described with reference to FIGS. 3 to 6.

Figure 3:
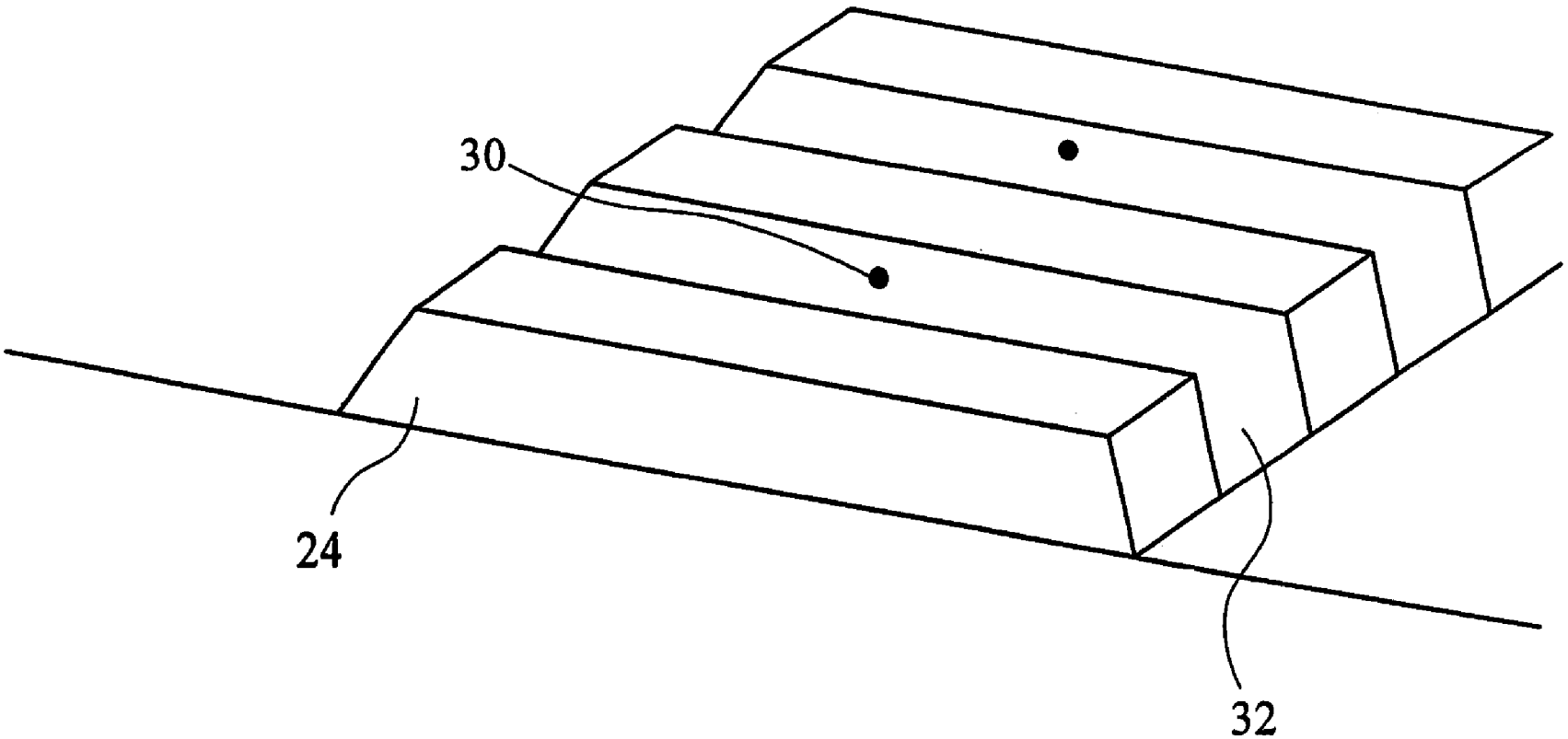
FIG. 3 is an expanded view of the print head of FIG. 2.

FIG. 3 is an expanded view of the print head of FIG. 2. The nozzles 30 are located midway along the channels 32. The dimensions of each of the channels are relatively small; typically the width is of the order 75 microns, the depth of 300 microns and the length approximately 1 mm. Since the head is capable of printing drops up to 50 pl at a frequency around 6.2 kHz, the greatest flow rate through the nozzles is about $3.1\times10^{-10}$ m3/s and thus at 10 times this flow rate, the velocity along the channel is 0.14 m/s.

Because some of the ink is ejected from the nozzles, the pressure drop along the first half of the channel is greater than that along the second half of the channel. In theory, these can be shown schematically as two restrictors, 56 and 58 in FIG. 4.

Figure 4:
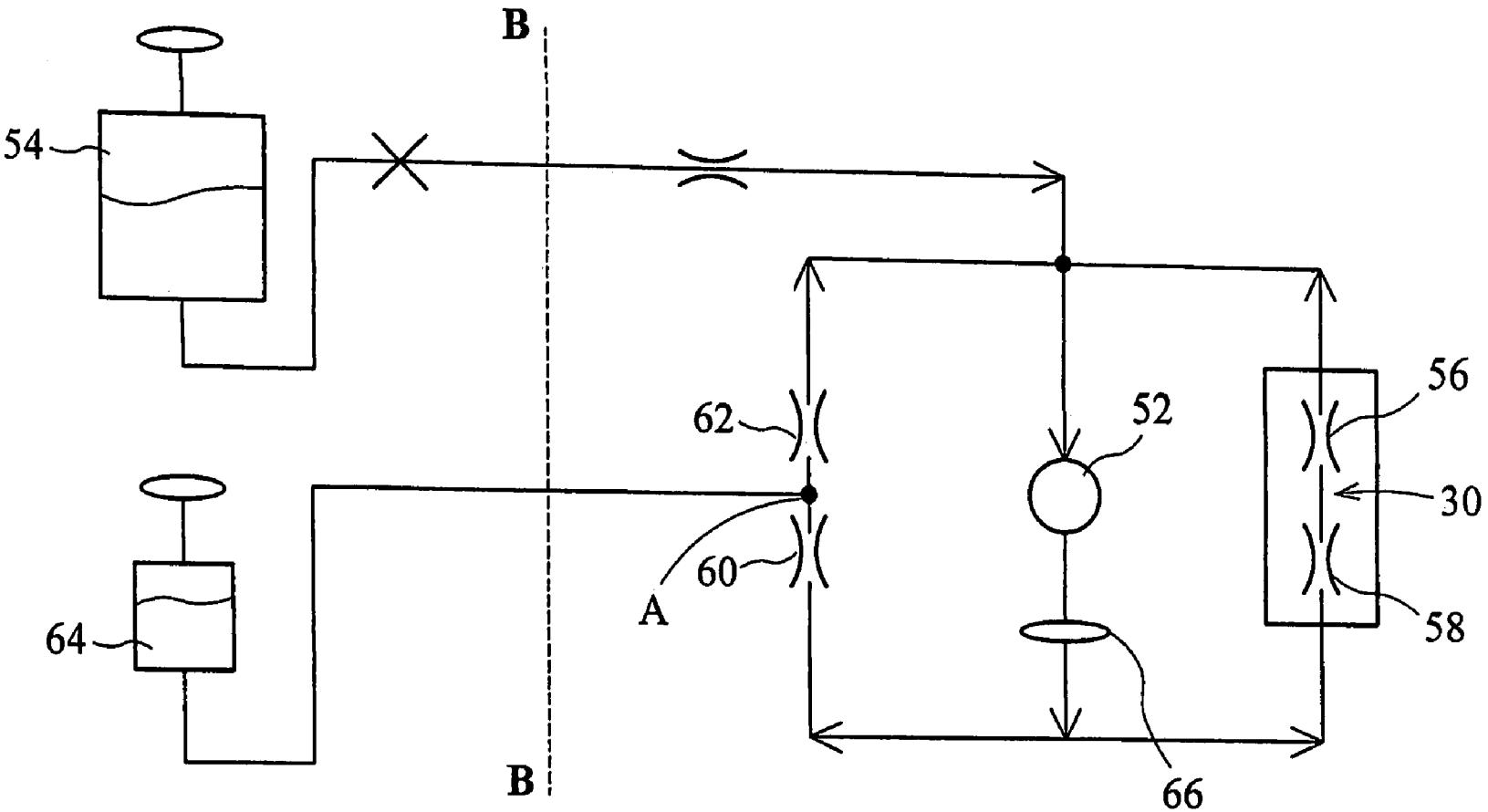
FIG. 4 depicts an ink supply circuit for a single row print head according to the present invention.

The ink supply according to the preferred embodiment of the present invention is depicted in FIG. 4. A single row, through flow print head is positioned in parallel with a pressure reference point A. Reference point A and the nozzles 30 are in a fixed spatial relationship with one another and with a pump 52 positioned so as to be able to supply ink to both reference point A and the nozzles simultaneously.

Unejected ink that flows from the print head is combined with ink flowing from the reference point A and used to feed the pump. Ink to replace that which is ejected from the nozzles is supplied to the ink downstream of either or both the reference point A and the nozzles from a bulk supply reservoir 54.

Schematically, the channels and manifolds within the print head are depicted as restrictors 56 and 58. Because the nozzles are positioned centrally within the channels, each of the restrictors 56, 58 provide substantially the same resistance.

Located either side of the reference point A are restrictors 60, 62. These are balanced with one another so that when ink is flowing round the circuit a positive pressure of approximately +2800 Pa is established at the opposite side of restrictor 60 and a negative pressure of approximately −3200 Pa is established at the opposite side of restrictor 62.

The circuits are balanced so that the pressure entering the printhead (i.e. upstream of restrictor 58) is similarly +2800 Pa and the pressure leaving the printhead (i.e. downstream of restrictor 56) is similarly −3200 Pa. Because of the pressure drops provided by the restrictors, this establishes a pressure at the nozzles 30 that is substantially the same as that at the pressure reference point A.

The restrictors can simply be a length of pipe, either a short piece with a narrow bore or a longer piece with a larger bore. In this example, the bore is of a moderate inner diameter so that erosion or build up of dirt will not have a significant effect on the symmetry of the system. Alternatively, the use of a valve will provide a greater operating freedom.

The pressure at the reference point A is controlled by the height of the liquid contained within the small control reservoir 64 with is open to the atmosphere. By raising the reservoir higher, the pressure at reference point A is increased and subsequently all the pressures within the supply circuit are also increased by a corresponding amount. By this simple movement, the pressure at the nozzles can be raised.

Similarly, by lowering the control reservoir, the pressure at reference point A is decreased and subsequently all the pressures within the supply circuit are also decreased by a corresponding amount. By this simple movement, the pressure at the nozzles can be lowered.

By altering the pressure within the small reservoir, it is possible to effect purging or sucking at the nozzles for maintenance purposes.

Turning to the hydraulic flows within the supply circuit, the pump must be sized so as to be able to achieve a flow of at least 10 times the maximum ejection rate through the print head and a flow, preferably in excess of this, through the pressure reference point A. A higher flow through the pressure reference point A of around 20 times the maximum ejection rate being preferred.

The pump must therefore be capable of pumping 30 times the maximum ejection rate i.e. $9.3\times10^{-9}$ $m^3/s$. Make up ink is supplied to the system at a rate of between 0 and $3.1\times10^{-10}$ $m^3/s$. Whilst this is typically not supplied in a smooth flow, because it is joining a flow around 30 times larger any pressure fluctuations are negligible. Indeed, it has been found that the system is tolerant to any flow surges caused by the pump. It is believed that the reason for this is that as the pump is located as a component in the circuit a fluctuation in flow at the pump outlet is matched by a corresponding fluctuation in flow at the pump inlet.

As the flow rate past the pressure reference point A is twice that of the flow through the head, any dirt particle in the system which avoids being caught in the filter 66 has twice the chance of flowing round the pressure reference circuit than through the print head. As the particle must pass through the filter 66 a second time before having a second opportunity to flow through the print head. Thus, the chance of any one particle causing a blockage in the print head is further reduced.

Whilst a higher flow rate of ink past the pressure reference point A is desirable it is no means essential. The important rate of flow is that through the print head and since this flow volume is preferably ten times the maximum printing volume there are, at least, nine times the maximum printing volume leaving the print head outlet. The probability of blockages is therefore reduced without a large flow passing through the pressure reference point.

Figure 5:
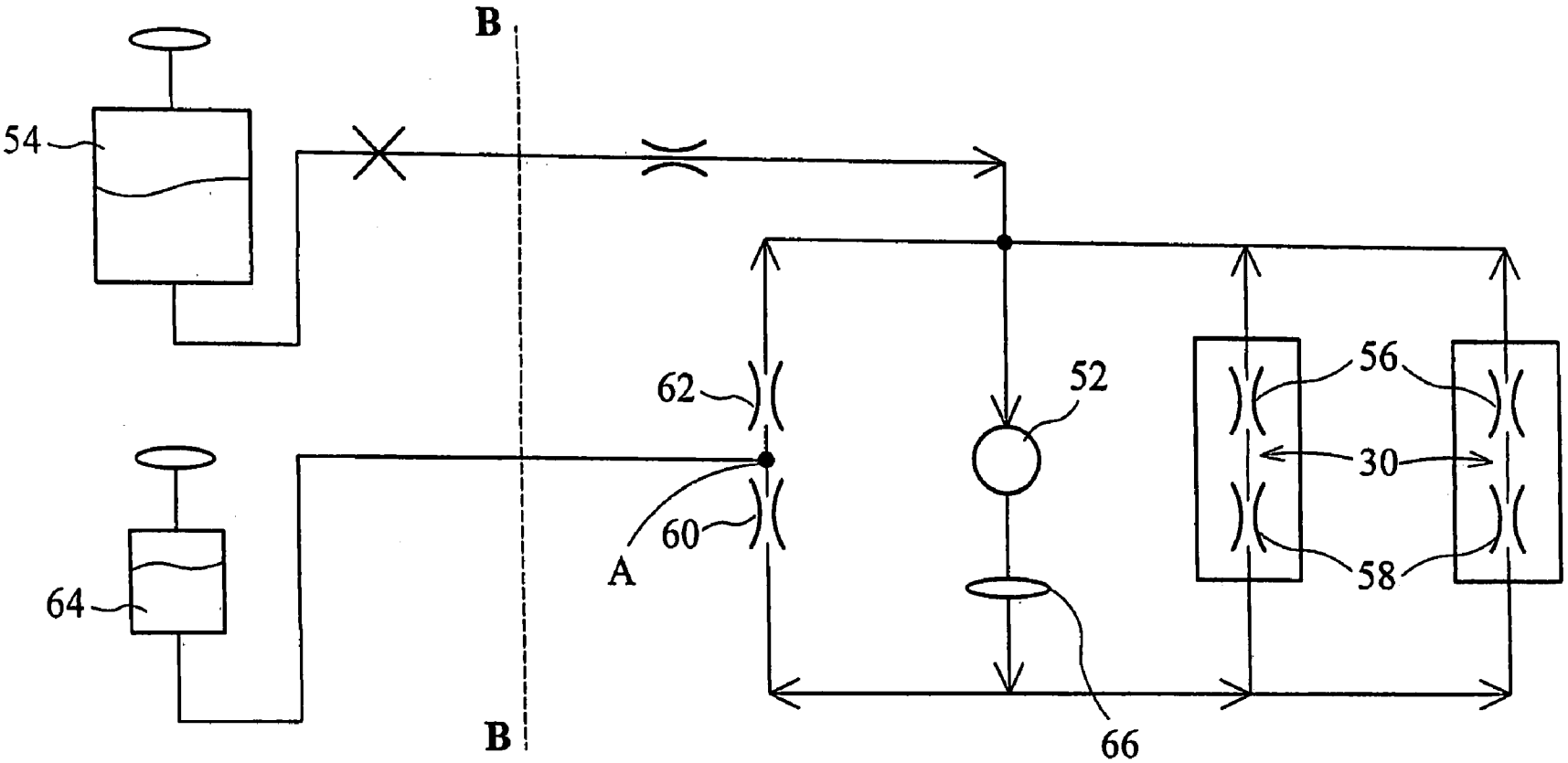
FIG. 5 depicts an ink supply circuit for a double row print head according to the present invention.

The schematic for a double row print head is depicted in FIG. 5. The ink is supplied to both rows from a single central manifold in parallel and non-ejected ink from both rows of ejection chambers is combined at an exit manifold.

The dashed line B—B in FIGS. 4 and 5 denotes the placement of equipment in a scanning application according to a further embodiment of the present invention. The circuit to the right of the line is placed onto the scanning carriage, whilst the reservoirs to the left of the line B—B are fixed.

Pressure fluctuations caused by acceleration of the carriage may be buffered using the small reservoir 64. As the pipe between the small reservoir and the pressure reference point A may be smaller that the pipes carrying the flow of ink around the circuit the pressure fluctuations may be controlled by relatively small changes in altitude of the small reservoir or, where the small reservoir is closed to atmosphere and the pressure actively controlled, relatively small changes to the pressure in the air space above the liquid.

In an alternative embodiment for the scanning arrangement the small reservoir may be mounted on the carriage. Where this is positioned below the print head no static pressure reference reservoir is required. If, however, it is inconvenient to place the small reservoir below the print head, it may be placed above and an air pipe running from the small reservoir to a static pressure control device may be used to establish the correct pressure at point A. Beneficially the air pipe does not give rise to a pressure difference under acceleration.

Figure 6:
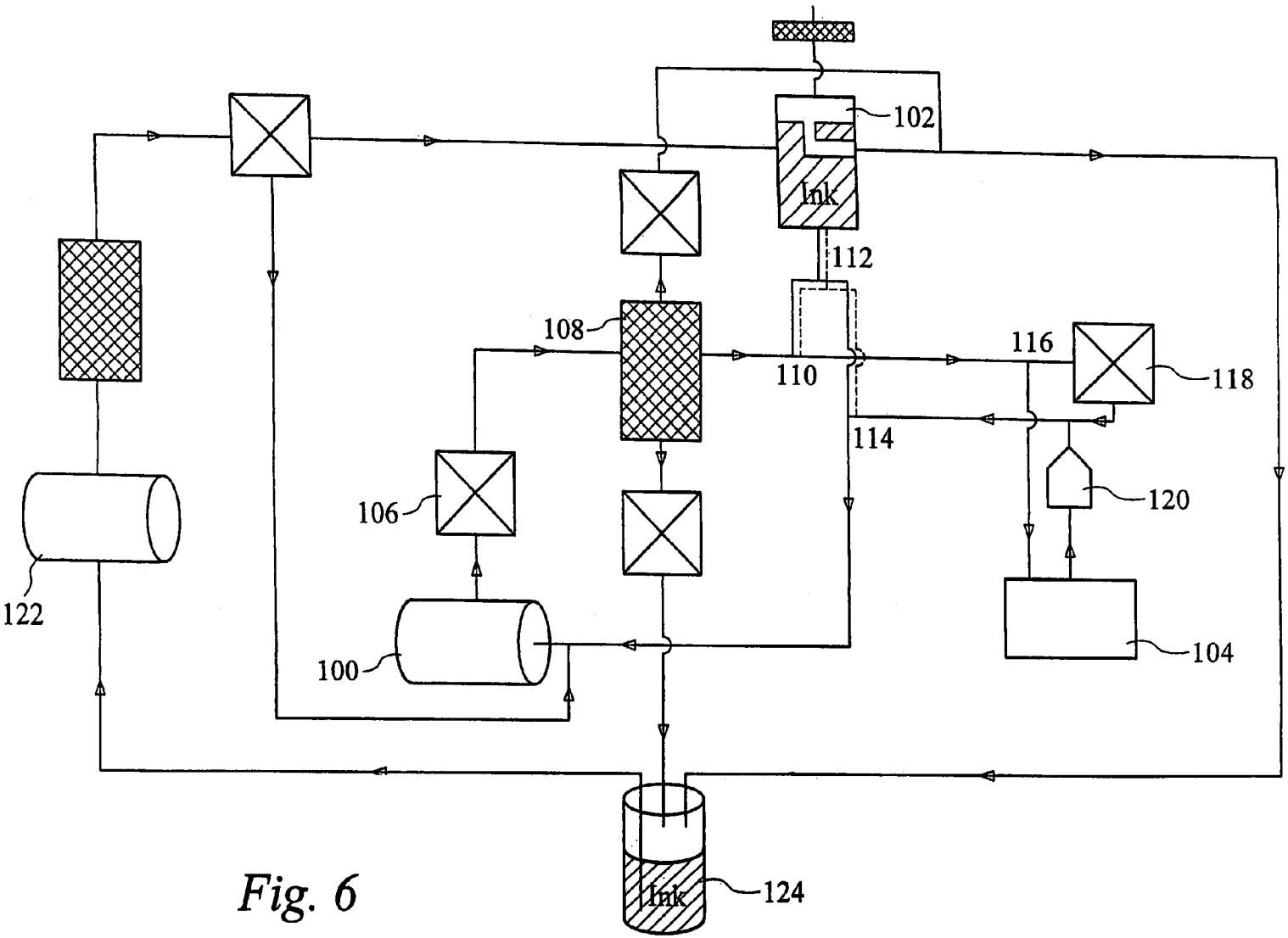
FIG. 6 depicts an ink supply circuit for a page wide array.

FIG. 6 depicts an ink supply for a page wide array. A main pump 100 circulates ink around a circuit that contains both a pressure control reservoir 102 and a print head 104.

Downstream of the pump is a flow control valve 106 and a filter 108 for removing dirt particles. The flow control valve maintains a steady flow of between 1 and 7 liters per minute. The bore of the pipe is around 10 mm in diameter.

Downstream of the filter, the circuit splits into two separate circuits in parallel. The first, marked, 110, 112, 114 is formed of a narrow bore tubing and includes a connection to a pressure control reservoir 102 open to atmospheric pressure. The narrow bore tubing is of the order 2 mm in diameter and its length is such that the pressure in the pressure control reservoir is reflected at the nozzles of the print head. The pressure control reservoir 102 contains around 100 ml of ink.

The second circuit 110, 116, 114 contains the print head 104. A by-pass valve 118, which is usually closed, and flow meter 120 are provided to facilitate operation. The flow through the head is typically between 1 and 7 liters per minute. The bore of the pipe is of the order 10 mm.

The two circuits combine at point 114 and the ink is circulated back to the pump 100. Ink from a make-up circuit is added at this point. The make up circuit has a pump 122 providing a flow below 1 liter per minute. The ink is filtered and supplies the pressure control reservoir 102. The make up ink for supply to the main pump 100 is removed at this point.

The level of ink in the pressure control reservoir is controlled by a weir, excess ink flowing out of an outlet to a lower bulk ink reservoir 124 used to supply the make-up pump 122.

Figure 7:
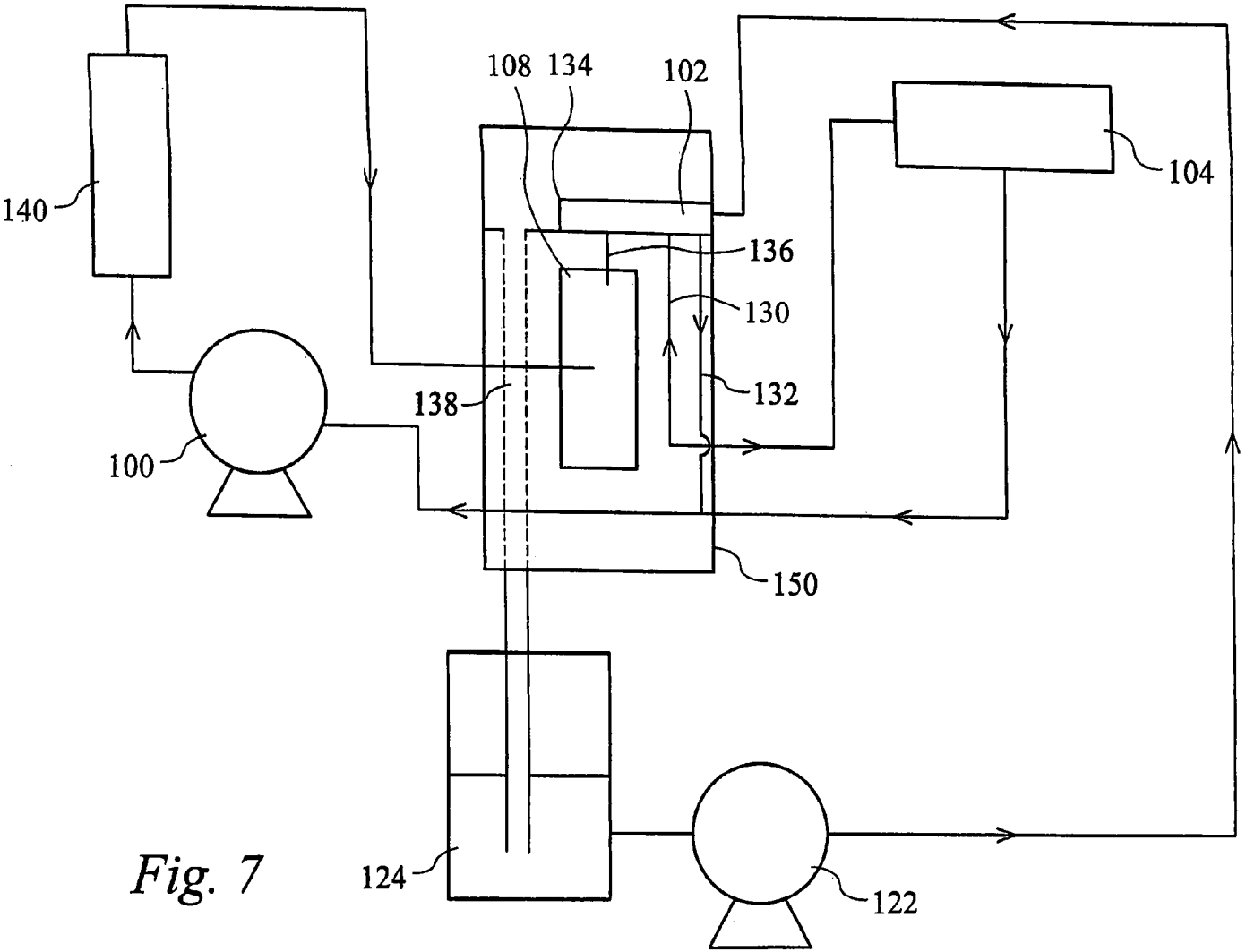
FIG. 7 depicts a further circuit for a print head.

A more elegant ink supply can be achieved by supplying the main filter 108, the pressure control reservoir 102 and the narrow bore tubing 130,132 as a single unit as shown in FIG. 7.

In this embodiment the pressure control reservoir 102 is placed in the single unit in a position above the filter and the unit itself has a size of the order 10 cm×10 cm×20 cm. For ease of reference the portion of the single unit comprising the pressure control reservoir is called the header portion and the portion comprising the filter the filter portion. The header portion is 3 cm in height and a weir 134 determines the level of liquid in the header portion which is open to atmosphere. A small bleed hole 136 allows air to pass from the filter portion to the header portion.

Top-up fluid to replace that printed by the print head 104 is supplied from a reservoir via a pump 122. The top-up fluid is supplied directly to the header portion and any excess flows over the weir 134 and returns to the reservoir via a non-porous tube 138 in the filter portion. The top-up fluid may be filtered prior to entering the header portion. The flow of ink through this portion is relatively low and typically well below 1 liter/minute.

Turning to the main ink circulation circuit, a pump, preferably a magnet pump supplies the fluid to a cooler to cool the ink before it reaches the filter portion. The outlet of this tube is located in the hollow of a filter. The filter 108 is preferably a tubular filter with a 5 cm OD and a height of 13 cm and a pore size of 5 μm. The ink flows through the filter and an outlet positioned towards the base of the filter housing is used to take ink to the print head. Beneficially this structure makes the system tolerant to air as any air must pass through the filter, rather than the bleed portion 136 and then downwards through the ink in the filter housing before passing to the print head.

The narrow bores 130 and 132 allow a flow of ink from the print head inlet to the print head outlet via the header portion and act as two arms of a bridge. The level of the fluid in the header tank portion is the pressure reference and sets the pressure at the nozzles.

Ink flows at a reasonable velocity through the narrow bore tubes and the pressure control reservoir 102 should be of a size such that no air is sucked down the return bore 132.

The resistances of these tubes are matched to the inlet and outlet tubes to the print head and the flow of fluid to the print head is of the order 1 liter/minute. The size of the tubes supplying ink to and from the print head must be of a size that allows for a sufficient velocity of ink to prevent air collecting; yet large enough to prevent an excessive pressure drop. It practice it has been found that a 10 mm bore with an inside diameter of 7 mm will works well. Where the diameter is 12 mm with an inside diameter of 10 mm is used it has been found the flow of ink is low enough to allow some air to collect however this air can easily be dislodged back into the ink stream by gentle tapping.

Each feature disclosed in this specification (which term includes the claims) and/or shown in the drawings may be incorporated in the invention independent of or in combination with other disclosed and/or illustrated features.

The invention claimed is:

1. A droplet deposition apparatus comprising:

at least one print head each having at least one nozzle for ejecting fluid from that print head;

fluid supply means for supplying fluid under pressure to said at least one print head; and pressure control means, located in said fluid supply means in parallel with the or each print head, for adjusting fluid pressure within said fluid supply means in order to control the fluid pressure at the or each nozzle during fluid ejection.

2. Apparatus according to claim 1, wherein pressurizing means are located in said fluid supply means in parallel with the or each print head and said pressure control means.

3. Apparatus according to claim 2, wherein a junction is provided in said fluid supply means downstream of said pressurizing means, wherein said junction divides said fluid supply means into at least two arms, and where downstream of said junction said pressure control means are located in one arm and the or each print heads are located in a different arm.

4. Apparatus according to claim 3, wherein a further junction is provided in said fluid supply means downstream of said pressure control means and wherein said further junction combines fluid in the arm from said pressure control means and fluid in the arm from the or each print head into a combined conduit.

5. Apparatus according to claim 4, wherein said combined conduit supplies said pressurizing means with fluid.

6. Apparatus according to claim 4, wherein the resistance of the arm between said pressure control means and said further junction and said nozzle in the or each print head and said further junction is substantially the same.

7. Apparatus according to claim 3, wherein the resistance of the arm between said junction and said pressure control means and said junction and said nozzle in the or each print head is substantially the same.

8. Apparatus according to claim 2, wherein said pressurizing means is a pump.

9. Apparatus according to claim 1, wherein said pressure control means is a reservoir containing a fluid having a surface open to atmospheric pressure.

10. Apparatus according to claim 9, wherein means are provided that can raise or lower said reservoir.

11. Apparatus according to claim 9, wherein said surface is at a lower altitude than said nozzles.

12. Apparatus according to claim 9, wherein said surface is at a higher altitude than said nozzles.

13. Apparatus according to claim 1, wherein said nozzle is located in an ejection chamber.

14. Apparatus according to claim 13, wherein said ejection chamber is supplied with fluid from an inlet manifold and ink is removed from said ejection chamber by an outlet manifold, said inlet and said outlet manifolds being different manifolds.

15. Method of supplying ink to a print head comprising controlling the pressure at the nozzle during fluid ejection by a remote point, said remote point being positioned in parallel with said print head.

16. A droplet deposition apparatus comprising:

a first fluid circuit arm containing at least one print head having at least one nozzle for ejecting fluid from that print head;

a second fluid circuit connected in parallel with said first fluid circuit arm and containing a fluid pump; and a third fluid circuit arm connected in parallel with said first and second fluid circuit arms and containing a pressure control device;

wherein the flow resistance in the first fluid circuit arm upstream of the nozzle is substantially equal to the flow resistance in the third fluid circuit arm upstream of the pressure control device, and wherein the flow resistance in the first fluid circuit arm downstream stream of the nozzle is substantially equal to the flow resistance in the third fluid circuit arm downstream of the pressure control device.

17. Apparatus according to claim 16, wherein said pressure control device is a reservoir containing a fluid having a surface open to atmospheric pressure.

18. Apparatus according to claim 17, wherein said reservoir is adjustable in height.

* * * * *